US009484614B2

(12) United States Patent
Herbsommer

(10) Patent No.: US 9,484,614 B2
(45) Date of Patent: Nov. 1, 2016

(54) DIELECTRIC WAVEGUIDE SIGNAL DIVIDER

(71) Applicant: Texas Instruments Incorporated, Dallas, TX (US)

(72) Inventor: Juan Alejandro Herbsommer, Allen, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 82 days.

(21) Appl. No.: 14/498,512

(22) Filed: Sep. 26, 2014

(65) Prior Publication Data

US 2015/0109070 A1 Apr. 23, 2015

Related U.S. Application Data

(60) Provisional application No. 61/894,765, filed on Oct. 23, 2013.

(51) Int. Cl.
*H01P 5/12* (2006.01)
*H01P 3/16* (2006.01)

(52) U.S. Cl.
CPC .. *H01P 5/12* (2013.01); *H01P 3/16* (2013.01)

(58) Field of Classification Search
CPC ..... H01P 5/16; H01P 3/16
USPC ..... 333/125, 137, 239
See application file for complete search history.

(56) References Cited

U.S. PATENT DOCUMENTS 2,745,101 A * 5/1956 Marie et al. ..... H01P 3/16 333/34
6,538,530 B2 * 3/2003 Kii et al. ..... H01P 5/188 333/1.1
2002/0027481 A1 * 3/2002 Fiedziuszko et al. .. H01P 1/203 333/116
2008/0025680 A1 * 1/2008 Sun et al. ..... G02B 6/02033 385/125

OTHER PUBLICATIONS

"3D Printing", Wikipedia, pp. 1-35, available at http://en.wikipedia.org/w/index.php?title=3D_printing&oldid=624190184 on Sep. 4, 2014.
Juan Alejandro Herbsommer, et al, "Dielectric Waveguide Manufactured Using Printed Circuit Board Technology", U.S. Appl. No. 13/854,935, filed Apr. 1, 2013, pp. 1-69.

* cited by examiner

*Primary Examiner* — Benny Lee
(74) *Attorney, Agent, or Firm* — John R. Pessetto; Charles A. Brill; Frank D. Cimino

(57) ABSTRACT

A dielectric waveguide (DWG) has a longitudinal core member with a first dielectric constant value surrounded by a cladding with a cladding dielectric constant value that is lower than the first dielectric constant value. A first port of a signal divider is connected to receive a signal from the DWG. A second port and a third port are each configured to output a portion of the signal received on the first port, wherein the first and second port are approximately in line and the third port is at an angle to a line formed by the first port and the second port. The first port and second port have a core member with the first dielectric constant value, and the third port has a core member with a second dielectric constant value that is higher than the first dielectric constant value.

8 Claims, 8 Drawing Sheets

DIELECTRIC WAVEGUIDE SIGNAL DIVIDER

CLAIM OF PRIORITY UNDER 35 U.S.C. 119(e)

The present application claims priority to and incorporates by reference U.S. Provisional Application No. 61/894,765 filed Oct. 23, 2013, entitled "Dielectric Waveguide Signal Divider."

FIELD OF THE INVENTION

This invention generally relates to dielectric wave guides for high frequency signals, and in particular to dividing a dielectric waveguide into two or more ports.

BACKGROUND OF THE INVENTION

In electromagnetic and communications engineering, the term "waveguide" may refer to any linear structure that conveys electromagnetic waves between its endpoints. The original and most common meaning is a hollow metal pipe used to carry radio waves. This type of waveguide is used as a transmission line for such purposes as connecting microwave transmitters and receivers to their antennas, in equipment such as microwave ovens, radar sets, satellite communications, and microwave radio links.

A dielectric waveguide employs a solid dielectric core rather than a hollow pipe. A dielectric is an electrical insulator that can be polarized by an applied electric field. When a dielectric is placed in an electric field, electric charges do not flow through the material as they do in a conductor, but only slightly shift from their average equilibrium positions causing dielectric polarization. Because of dielectric polarization, positive charges are displaced toward the field and negative charges shift in the opposite direction. This creates an internal electric field which reduces the overall field within the dielectric itself. If a dielectric is composed of weakly bonded molecules, those molecules not only become polarized, but also reorient so that their symmetry axis aligns to the field. While the term "insulator" implies low electrical conduction, "dielectric" is typically used to describe materials with a high polarizability; which is expressed by a number called the relative permittivity ($\in k$). The term "insulator" is generally used to indicate electrical obstruction while the term "dielectric" is used to indicate the energy storing capacity of the material by means of polarization.

Permittivity is a material property that expresses a measure of the energy storage per unit meter of a material due to electric polarization (Joules/Volts$^2$)/meter. Relative permittivity is the factor by which the electric field between the charges is decreased or increased relative to vacuum. Relative permittivity is also commonly known as dielectric constant.

The electromagnetic waves in a metal-pipe waveguide may be imagined as travelling down the guide in a zig-zag path, being repeatedly reflected between opposite walls of the guide. For the particular case of a rectangular waveguide, it is possible to base an exact analysis on this view. Propagation in a dielectric waveguide may be viewed in the same way, with the waves confined to the dielectric by total internal reflection at its surface.

BRIEF DESCRIPTION OF THE DRAWINGS

Particular embodiments in accordance with the invention will now be described, by way of example only, and with reference to the accompanying drawings.

Figure 1:
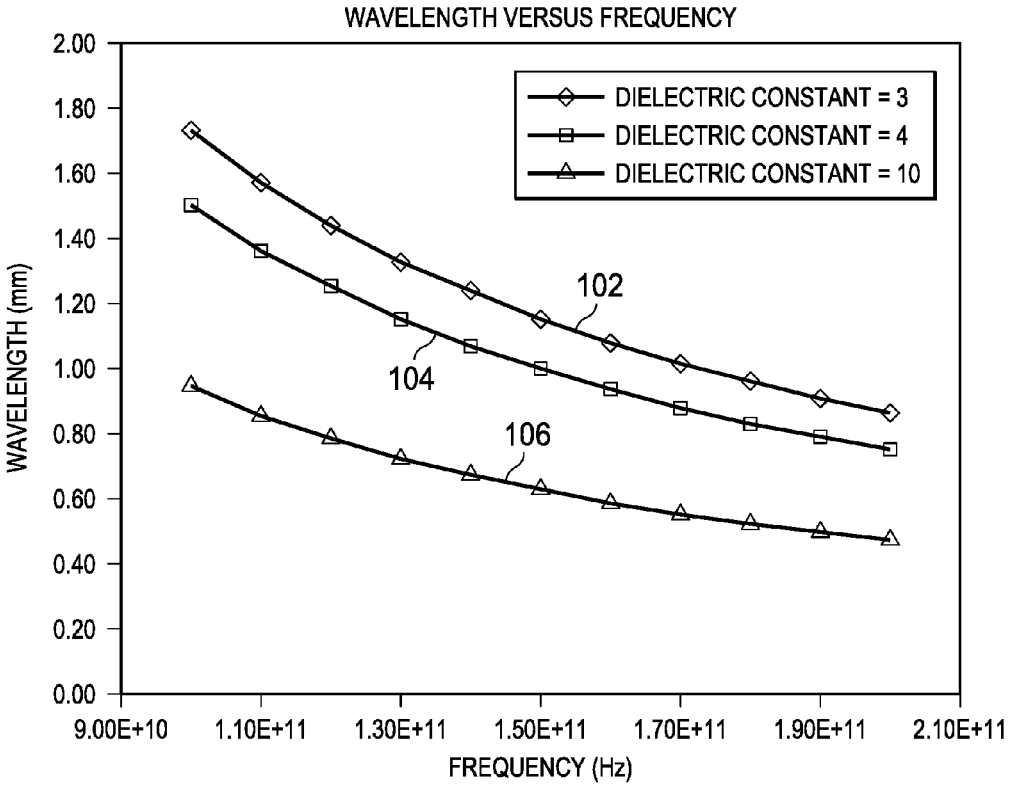
FIG. 1 is a plot of wavelength versus frequency through materials of various dielectric constants.

Other features of the present embodiments will be apparent from the accompanying drawings and from the detailed description that follows.

DETAILED DESCRIPTION OF EMBODIMENTS OF THE INVENTION

Specific embodiments of the invention will now be described in detail with reference to the accompanying figures. Like elements in the various figures are denoted by like reference numerals for consistency. In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

As frequencies in electronic components and systems increase, the wavelength decreases in a corresponding manner. For example, many computer processors now operate in the gigahertz realm. As operating frequencies increase to the sub-terahertz range, the wavelengths become short enough that signal lines that exceed a short distance may act as an antenna and signal radiation may occur. FIG. 1 is a plot of wavelength in mm versus frequency in Hz through materials of various dielectric constants. As illustrated by plot 102 which represents a material with a low dielectric constant of 3, such as a printed circuit board, a 100 GHz signal will have a wavelength of approximately 1.7mm. Thus, a signal line that is only 1.7mm in length may act as a full wave antenna and radiate a significant percentage of the signal energy. Plot 104 in FIG. 1 has a dielectric constant of 4. Plot 106 in FIG. 1 has a dielectric constant of 10.

Waves in open space propagate in all directions, as spherical waves. In this way they lose their power proportionally to the square of the distance; that is, at a distance R from the source, the power is the source power divided by $R^2$. A wave guide may be used to transport high frequency signals over relatively long distances. The waveguide confines the wave to propagation in one dimension, so that under ideal conditions the wave loses no power while propagating. Electromagnetic wave propagation along the axis of the waveguide is described by the wave equation, which is derived from Maxwell's equations, and where the wavelength depends upon the structure of the waveguide, and the material within it (air, plastic, vacuum, etc.), as well as on the frequency of the wave. Commonly-used waveguides are only of a few categories. The most common kind of waveguide is one that has a rectangular cross-section, one that is usually not square. It is common for the long side of this cross-section to be twice as long as its short side. These are useful for carrying electromagnetic waves that are horizontally or vertically polarized.

For the exceedingly small wavelengths encountered for sub-THz radio frequency (RF) signals, dielectric waveguides perform well and are much less expensive to fabricate than hollow metal waveguides. Furthermore, a metallic waveguide has a frequency cutoff determined by the size of the waveguide. Below the cutoff frequency there is no propagation of the electromagnetic field. Dielectric waveguides have a wider range of operation without a fixed cutoff point. Various types of dielectric waveguides and techniques for coupling a dielectric waveguide to an integrated circuit or to another dielectric waveguide are described herein.

Various configurations of dielectric waveguides (DWG) and interconnect schemes are described in US Publication number 2014/0285277 entitled "Dielectric Waveguide Manufactured Using Printed Circuit Board Technology" and are incorporated by reference herein. Various antenna configurations for launching and receiving radio frequency signals to/from a DWG are also described therein and are incorporated by reference herein.

A DWG may be used to provide point to point communications between two nodes. However, in some cases multipoint communication between more than two nodes is needed. Embodiments of the invention may include a DWG signal divider that allows one transceiver node to communicate directly with two or more other transceiver nodes, as will be described in more detail below.

As discussed above, for point to point communications using modulated radio frequency (RF) techniques, dielectric waveguides provide a low-loss method for directing energy from a transmitter (TX) to a receiver (RX). Many configurations are possible for the waveguides themselves. A solid DWG may be produced using printed circuit board (PCB) technology, for example. Generally, a solid DWG is useful for short interconnects or longer interconnects in a stationary system. PCB manufacturers have the ability to create board materials with different dielectric constants by using microfillers as dopants, for example. A dielectric waveguide may be fabricated by routing a channel in a low dielectric constant (∈k2) board material and filling the channel with high dielectric constant (∈k1) material, for example. However, their rigidity may limit their use where the interconnected components may need to be moved relative to each other.

A flexible waveguide configuration may have a core member made from flexible dielectric material with a high dielectric constant (∈k1) and be surrounded with a cladding made from flexible dielectric material with a low dielectric constant, (∈k2). While theoretically, air could be used in place of the cladding, since air has a dielectric constant of approximately 1.0, any contact by humans, or other objects may introduce serious impedance mismatch effects that may result in signal loss or corruption. Therefore, typically free air does not provide a suitable cladding.

Figure 2:
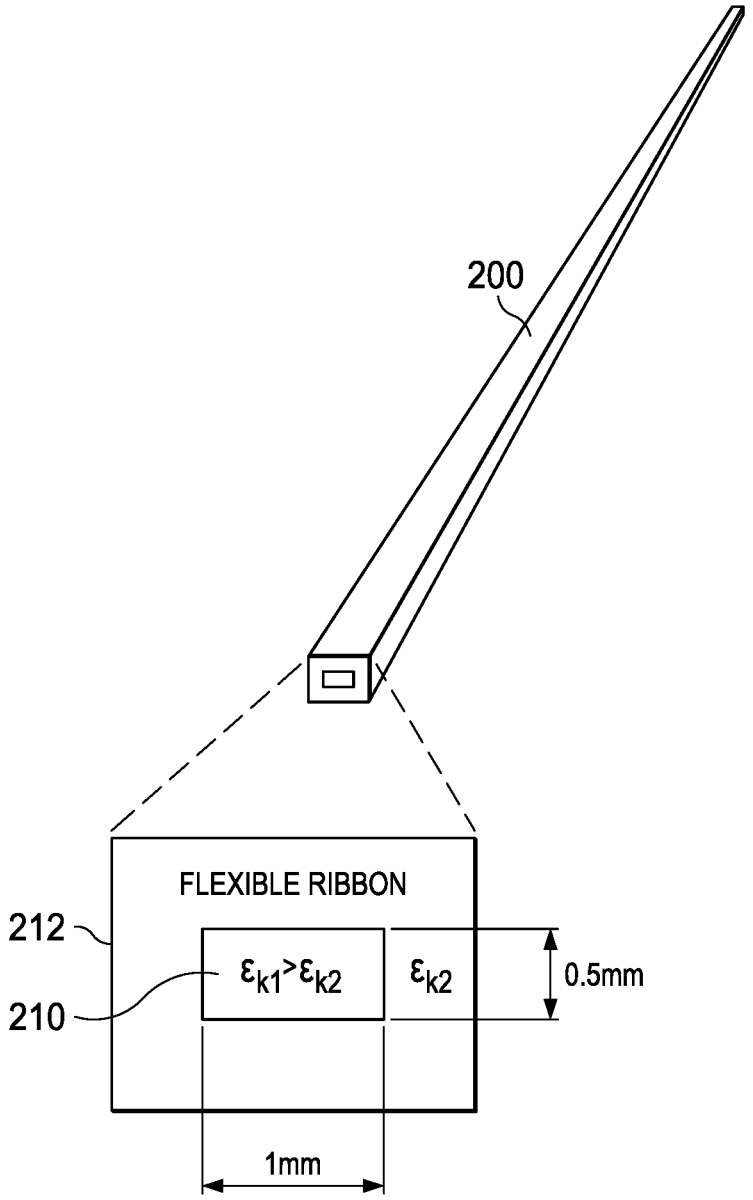
FIG. 2 is an illustration of an example flexible DWG.

FIG. 2 illustrates a flexible DWG 200 that is configured as a thin flexible ribbon of the core material surrounding by the cladding material. In this example, a thin rectangular ribbon of the core material 210, where (∈k1) is greater than (∈k2), is surrounded by the cladding material 212, where the cladding material 212 has a dielectric constant (∈k2). For sub-terahertz signals, such as in the range of 130-150 gigahertz, a core dimension of approximately 0.5mm × 1.0mm works well. DWG 200 may be manufactured using known extrusion techniques, for example.

In another embodiment, various DWG configurations may be fabricated using a printing process, such as an inkjet printer or other three dimensional printing mechanism. Fabrication of three dimensional structures using ink jet printers or similar printers that can "print" various polymer materials is well known and need not be described in further detail herein. For example, see "3D Printing," Wikipedia, Sep. 4, 2014. Printing allows for the rapid and low-cost deposition of thick dielectric and metallic layers, such as 0.1 um - 1000 um thick, for example, while also allowing for fine feature sizes, such as 20 um feature sizes, for example. Standard integrated circuit (IC) fabrication processes are not able to process layers this thick. Standard macroscopic techniques, such as machining and etching, typically used to manufacture dielectric waveguides and metallic structures may only allow feature sizes down to 1 mm, for example. These thicker printed dielectric and metallic layers on the order of 100 nm - 1 mm which are made possible by inkjet printing enable waveguide operation at Sub-THz and THz frequencies; previously only optical frequencies could be reached using standard fabrication methods. Printing the waveguides directly onto the chip/package/board mitigates alignment errors of standard waveguide assemblies and simplifies the packaging process.

Figure 3:
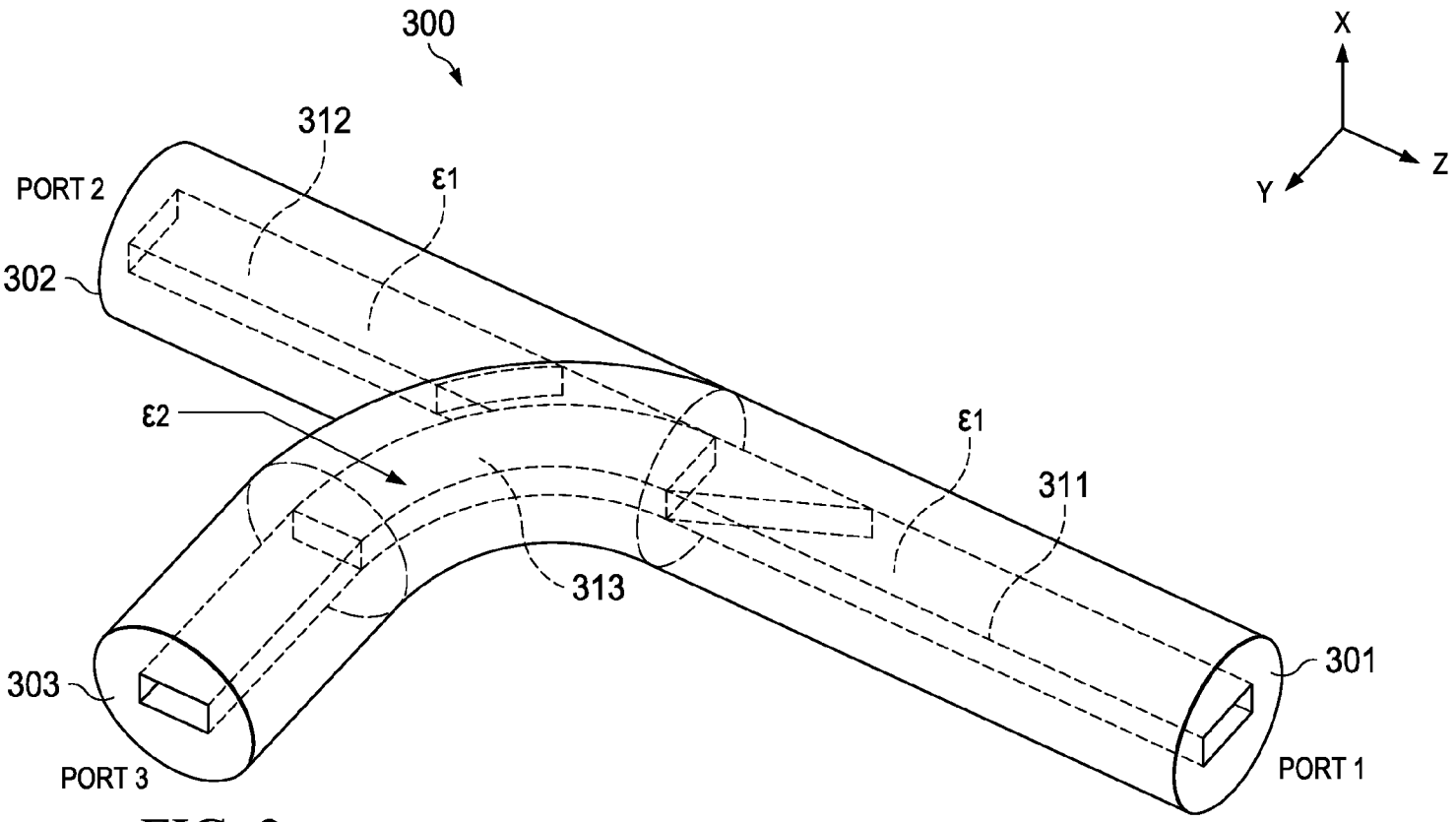
FIGS. 3 and 4 are illustrations of an example DWG signal divider.
Figure 4:
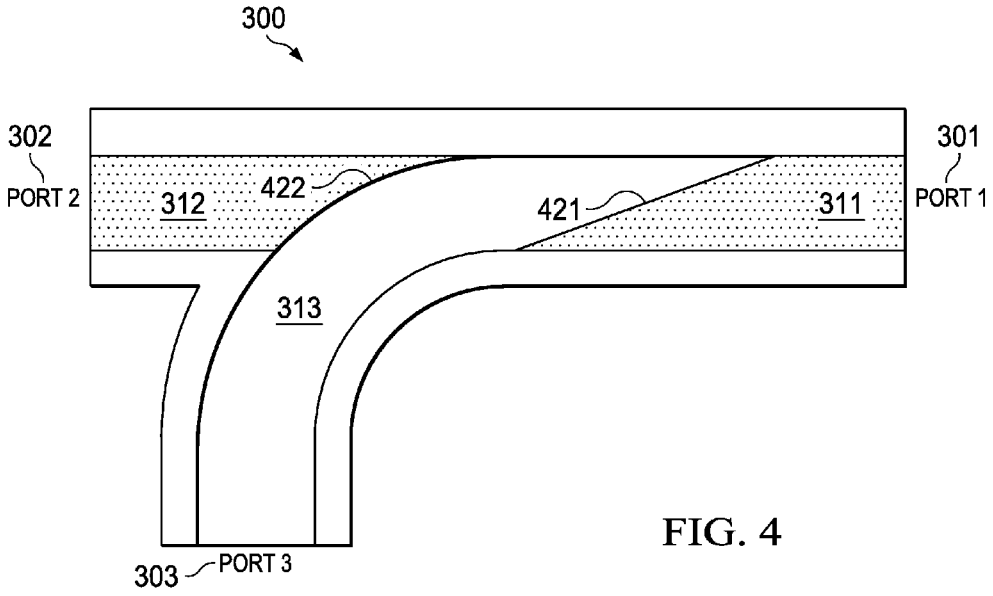

FIGS. 3 and 4 are illustrations of an example DWG signal divider 300 having three ports 301, 302, 303. As discussed above, a dielectric waveguide (DWG) may be used as an interconnect to communicate chip to chip in a system or system to system, for example. In many DWG applications, it may be necessary to send an electromagnetic signal from one source node to be received by two or more receiving nodes with a controlled signal strength at each end. Embodiments of signal divider 300 allow a signal received on port 301 to be split and sent out on both port 302 and port 303. FIG. 3 is illustrated in the X, Y and Z dimensions.

In order to cause a significant amount of signal to bifurcate through the bent portion of divider 300 and feed port 3, the signal divider may use two different materials for the core. In this example, the magnitude of the electromagnetic field in port 2 and port 3 is controlled by the selection of two different dielectric constant materials for the core. This device has a core and cladding made of different polymers as explained above. Additionally, in this case the device is made of two different cores materials and only one cladding polymer. Core portions 311, 312 are implemented with a core material having dielectric constant ∈1 and core portion 313 is implemented with a polymer having dielectric constant ∈2. In general, in order to produce a significant signal strength at port 3, the divider is designed with ∈2>∈1 in order to overcome the tendency of the electromagnetic wave to keep moving straight from port 1 to port 2.

As shown in FIG. 4 in order to minimize the impedance mismatch between the different dielectric core materials, a taper or smooth transition region 421 is provided between the materials with dielectric constants ∈1 and ∈2. In this example, the taper is linear; however, in another embodiment the taper may be non-linear. The overall length of the taper should be several wavelengths of the signal in order to provide a smooth impedance transition.

Curved interface 422 between core region 312 having dielectric constant ∈1 and core region 313 having dielectric constant ∈2 causes a portion of an electromagnetic signal received on port 1 to be diverted to port 3, while another portion of the signal proceeds through curved interface 422 to port 2. The amount of signal diversion depends on the difference between dielectric constant ∈1 and dielectric constant ∈2, as will be discussed in more detail with regard to FIGS. 8-9. The radius, or angle, at which port 3 diverges from port 2 also affects how much signal is diverted to port 3.

Figure 5:
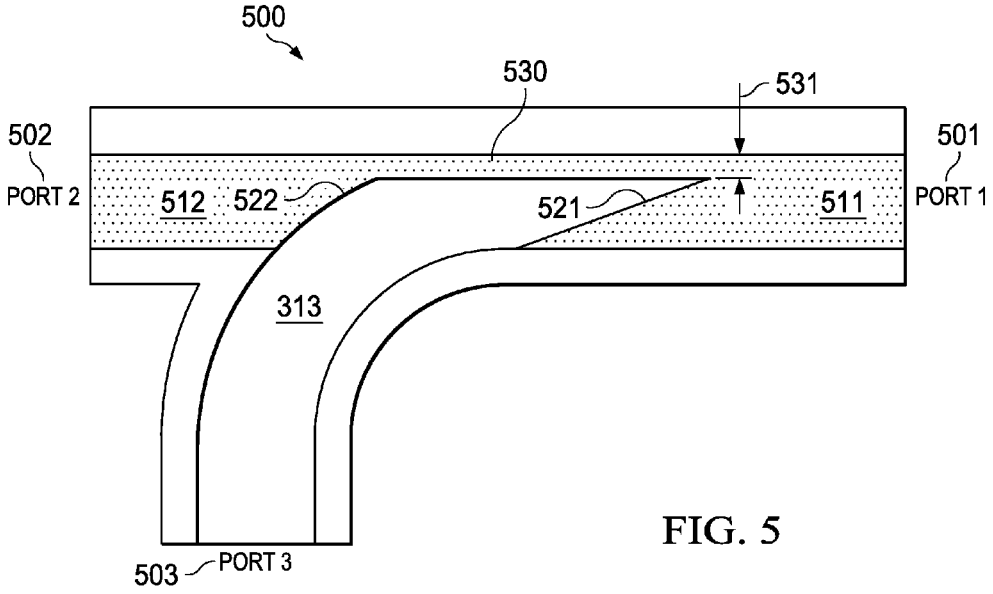
FIGS. 5-7 illustrate various alternative embodiments of a DWG signal divider.

FIG. 5 illustrates an alternative embodiment of a DWG signal divider 500. In this example, there is a portion 530 of core material between port 1 501 and port 2 502 that is implemented using the same dielectric constant ∈1 as core regions 511 and 512. Tapered region 521 and curved interface region 522 are therefore smaller than the equivalent regions of divider 300. In this manner, a portion of a signal introduced into port 1 will proceed straight through region 530 to port 2.

The design width 531 of region 530 may be increased or decreased to allow more or less signal from port 1 to be diverted to port 3 503, for example.

Figure 6:
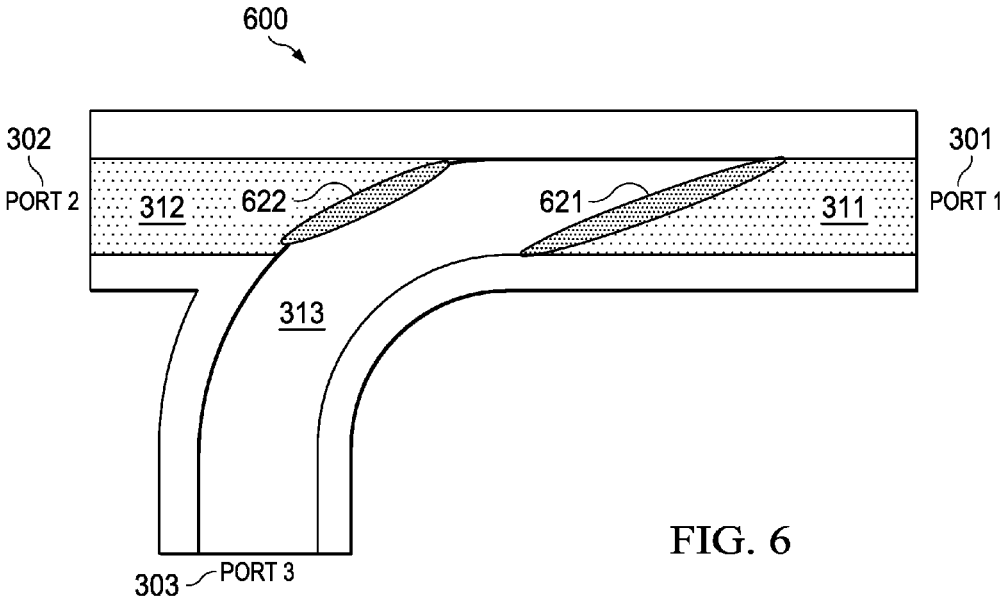

FIG. 6 illustrates an alternative embodiment of a DWG signal divider 600. In this example, tapered interface 621 provides a gradual change between dielectric constant ∈1 and dielectric constant ∈2. The shape of interface region may be enlarged to encompass a more or less rectangular region that provides a gradual change in dielectric constant value between dielectric constant ∈1 and dielectric constant ∈2, for example. As mentioned above, the overall length of the transition region should be several wavelengths of the target signal.

In a similar manner, curved interface 622 may also provide a gradual change between dielectric constant ∈1 and dielectric constant ∈2, for example.

Figure 7:
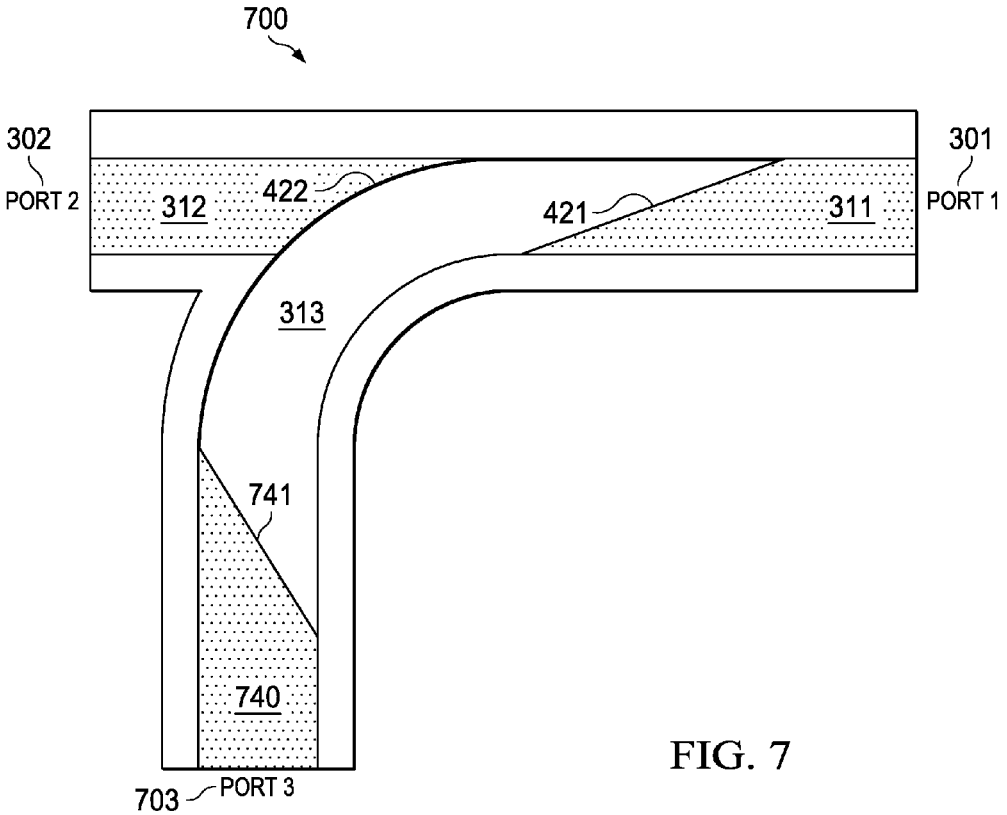

FIG. 7 illustrates an alternative embodiment of a DWG signal divider 700. In this example, tapered interface 741 provides a gradual change between dielectric constant ∈2 in core portion 313 and dielectric constant ∈3 in core region 740. In this example, the taper is linear; however, in another embodiment the taper may be non-linear. The overall length of the taper should be several wavelengths of the signal in order to provide a smooth impedance transition. Typically, dielectric constant ∈3 may be designed to be the same value as dielectric constant ∈1. In this manner, similar DWGs may be connected to ports 1, 2, and 3 703 that all have a same core dielectric constant value without any significant impedance mismatch.

Figure 8:
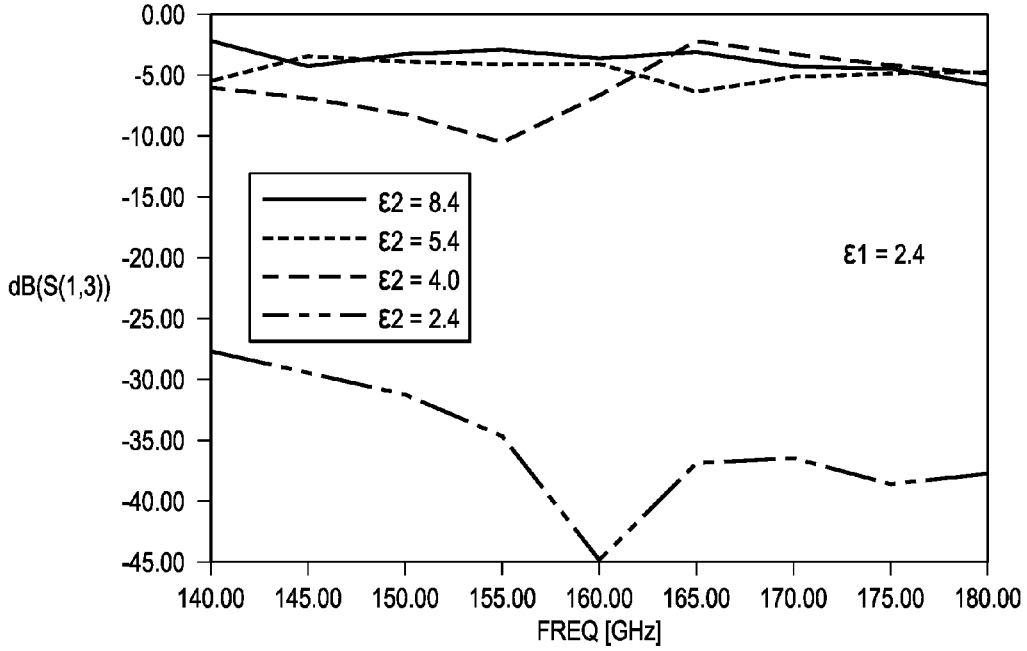
FIGS. 8-9 are plots illustrating operation of the DWG signal divider of FIG. 3.
Figure 9:
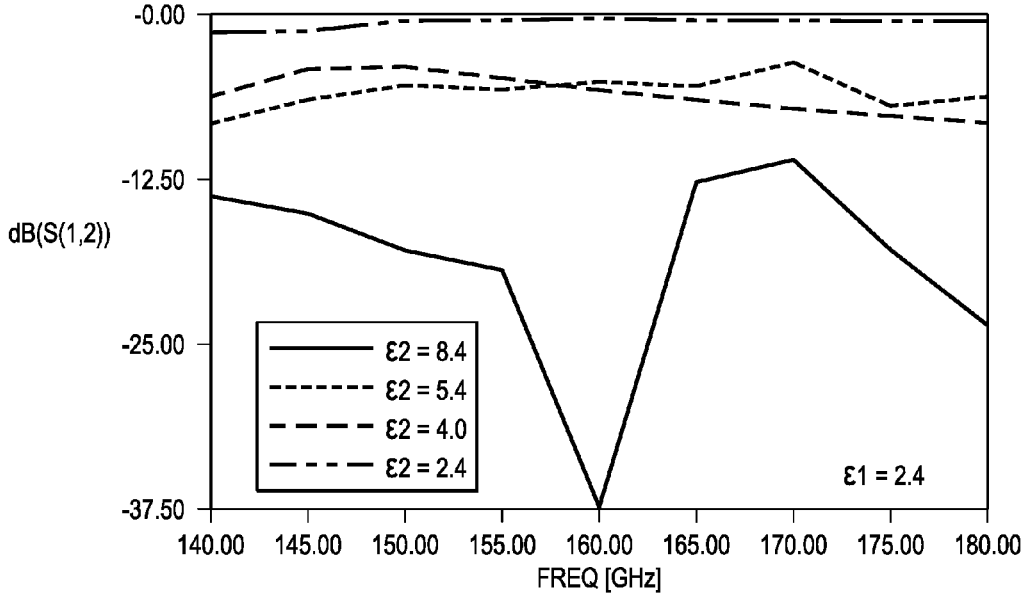

FIGS. 8 and 9 are plots illustrating the S-parameters of the signal divider 300 above for ∈1=2.4 and ∈_cladding=2.1 with ∈2 having values at 2.4, 4.0, 5.4 and 8.4. The x axis on the plot of FIG. 8 and the plot of FIG. 9 is frequency in gigahertz FREQf[GHz]. The y axis on the plot of FIG. 8 is dB(S(1,3)). The y axis on the plot of FIG. 9 is dB(S(1,2)). FIG. 8 illustrates S-parameters for port 1-port 3, while FIG. 9 illustrates S-parameters for port 1-port 2. It can be seen in FIG. 8 that the magnitude of the signal at port 3 (dB(S1,3) increases when the value of ∈2 is changed from 2.4 to 8.4. In this way it is possible to design a desired bifurcation and signal strength by choosing the proper ∈2.

Notice that the plots for ∈2=5.4 ∈2=8.4 indicate a possible saturation effect in which a further increase in dielectric value may not have a significant effect on the S-parameter performance of the divider.

Figure 10B:
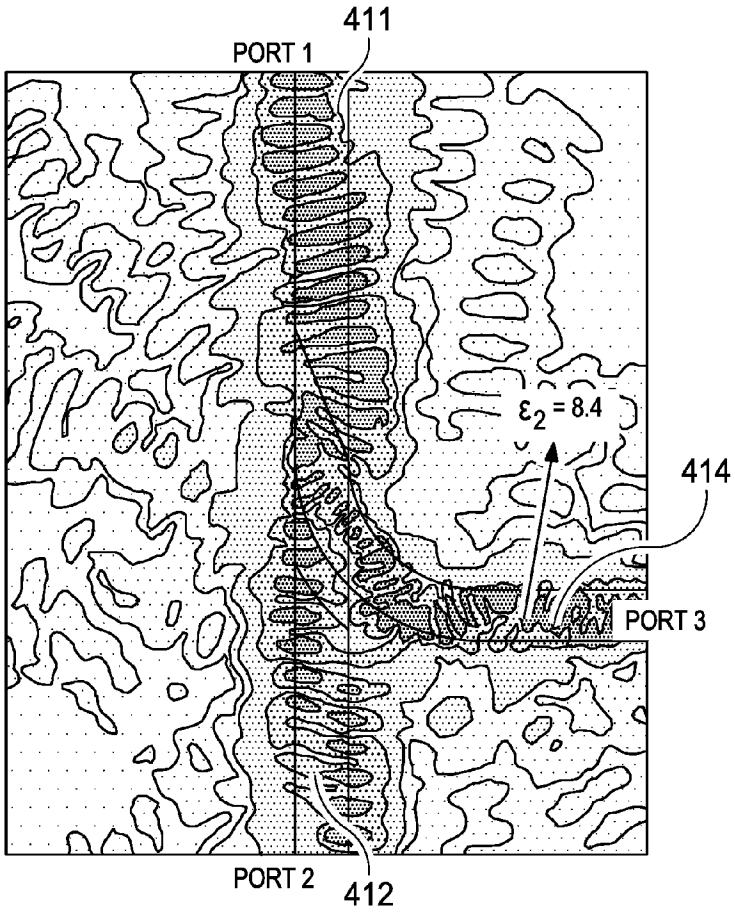
FIGS. 10A, 10B are simulations illustrating operation of the signal divider of FIG. 3.
Figure 10A:
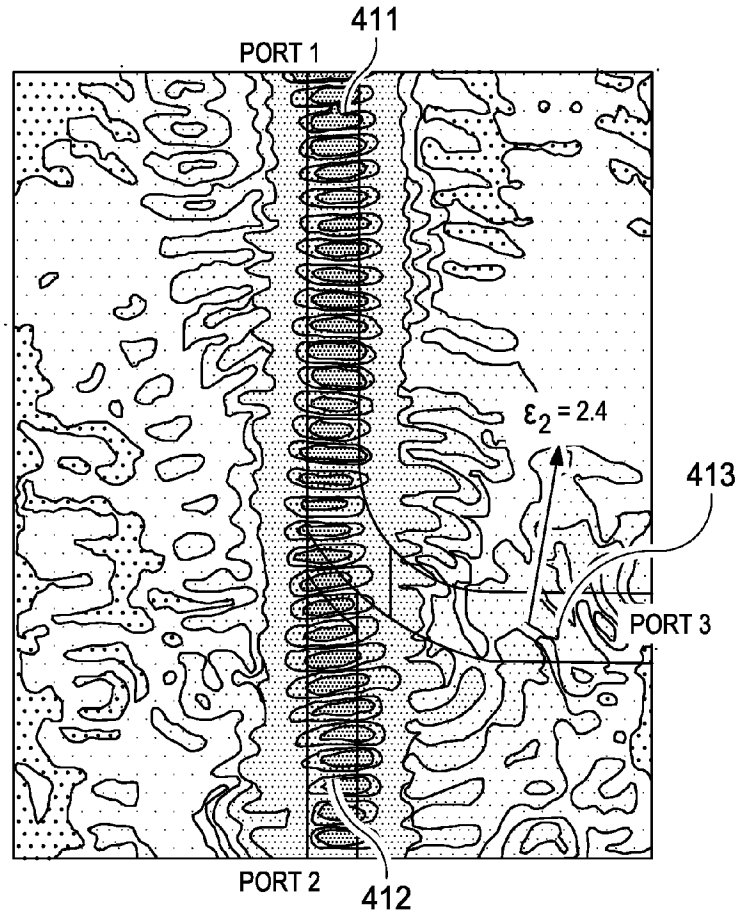

FIGS. 10A, 10B are simulations illustrating operation of signal divider 300 at the extremes of core region 413 with ∈2=2.4 in FIG. 10A and region 414 with ∈2=8.4 in FIG. 10B. Notice that in FIG. 10A, essentially no signal is diverted to port 3 where ∈1=∈2=2.4. Due to the momentum of the electromagnetic wave, the signal will have the tendency to keep moving in a straight path from port 1 to port 2.

Notice in FIG. 10B, the wavelength of the signal that is diverted to port 3 is shorter because the dielectric constant of core portion 414 is higher than core portion 411, 412.

The same concept may be used to create bifurcations from one source to more than two ends and with arbitrary angles.

Figure 11:
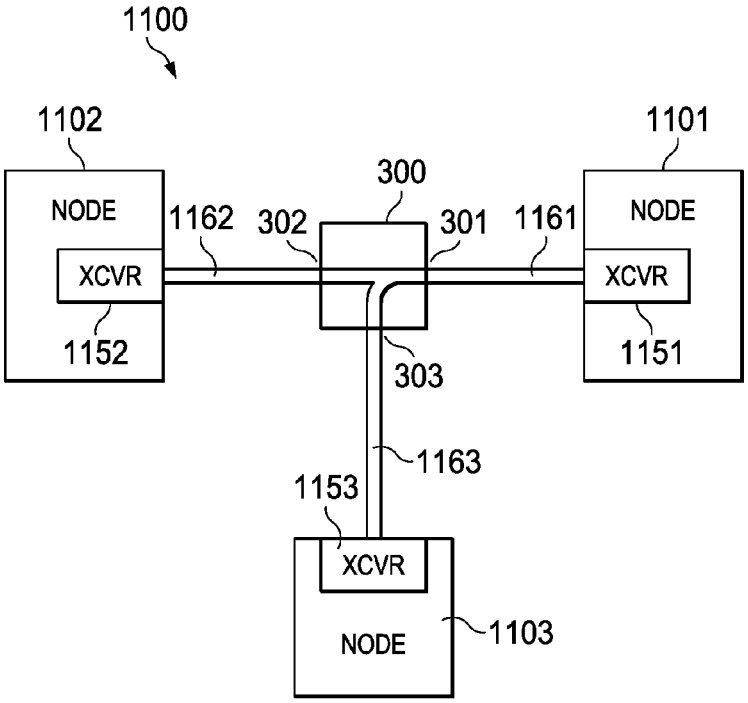
FIG. 11 is an illustration of three system nodes being interconnected with a DWG using the signal divider of FIG. 3.

FIG. 11 is an illustration of a system 1100 that has at least three nodes 1101, 1102 1103 that are interconnected with DWGs 1161, 1162, 1163 using a signal divider 300. The three modes may be a computing device and two peripheral devices or three computing devices, for example. The nodes may be any form of computing device, such as, but not limited to: a system on a chip (SOC), a rack mount, desk mount, or portable computer, a mobile user device such a notebook computer, a tablet computer, a smart phone, etc, for example. The nodes may be any type of peripheral device such as: a media storage device such as rotating or solid state disk drive, a modem or other interface to a high speed network, etc, for example. Each node may be an integrated circuit. All of the nodes may be mounted on a common circuit board substrate, for example.

Each node 1101, 1102, 1103 may be an SOC or contain a PWB or other type substrate on which are mounted one or more integrated circuits that produce or receive a sub-terahertz signal that is coupled to a DWG using transceivers (XCVR) 1151, 1152, 1153, for example. The manner of coupling between the IC and the DWG may be implemented using any of the techniques described in more detail in US Publication number 2014/0285277 or later developed, for example.

DWGs 1161, 1162, and 1163 may be any form of flexible or rigid DWG as described in more detail above, for example. The DWG may be a combination cable, such as an enhanced USB cable that includes a DWG, for example. One or more of the connections may use an RJ45 connector, for example. There may be a single DWG, or there may be multiple DWGs, depending on the requirements of the systems.

DWGs 1161, 1162, 1163 and signal divider 300 may all be formed on a single substrate using PWB fabrication techniques, for example. In another embodiment DWGs 1161, 1162, 1163 and signal divider 300 may all be formed on a single substrate using ink jet printing techniques, for example. In another embodiment, DWGs 1161, 1162, 1163 and signal divider 300 may be formed using diffusion techniques to produce different dielectric constant values in a polymer material, for example.

Figure 12:
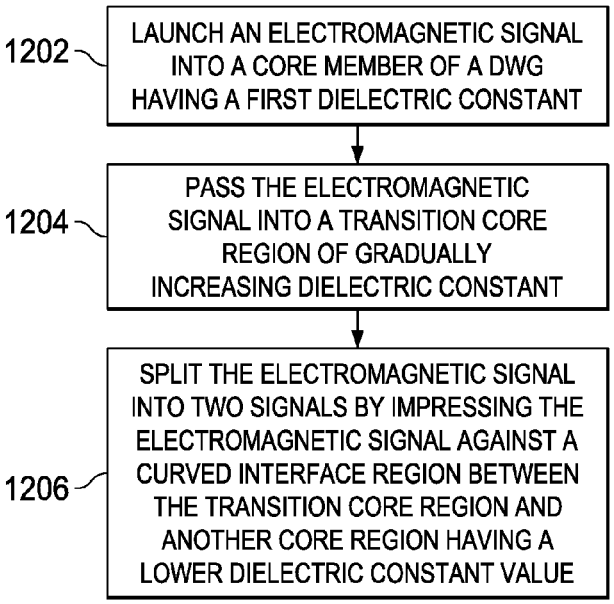
FIG. 12 is a flow chart illustrating operation of a DWG signal divider.

FIG. 12 is a flow chart illustrating operation of a DWG signal divider. An electromagnetic signal is launched at step 1202 into a core member of the DWG, wherein the core member has a first dielectric constant value. As discussed above, the signal may be launched into the DWG using a variety of antenna structures that are driven by a transmitter circuit in a system node, for example.

The electromagnetic signal is passed at step 1204 into a transition core region having a dielectric constant value that gradually changes from the first dielectric constant value to a higher dielectric constant value. As described above, the transition region may provide a linear transition or a non-linear transition of the dielectric constant value.

The electromagnetic signal is split at step 1206 by impressing the electromagnetic signal against a curved interface region between the transition core region having the higher dielectric constant value and another core region having a lower dielectric constant value, such that a portion of the electromagnetic signal proceeds straight through the curved interface region to a first output port while a second portion of the electromagnetic signal is reflected by the curved interface and proceeds to a second output port. As discussed in more detail above, the ratio of signal strength output by the two ports is dependent upon the difference in the value of the higher dielectric constant and the lower dielectric constant value, and the angle or radius of the curved interface region.

In some embodiments, the second portion of the electromagnetic signal may be passed through a second transition region having a dielectric constant value that gradually changes from the higher dielectric constant value to the first dielectric constant value.

As shown by the above descriptions and examples, three or more electronic devices may be easily interconnected to provide sub-terahertz communication paths between the electronic devices by using the techniques described herein.

OTHER EMBODIMENTS

While the invention has been described with reference to illustrative embodiments, this description is not intended to be construed in a limiting sense. Various other embodiments of the invention will be apparent to persons skilled in the art upon reference to this description. For example, the DWGs may be rigid, flexible, free standing, mounted on a substrate, etc.

The cladding of the DWG and signal divider may be selected from a range of approximately 2.1-4.5, for example. The core of the DWG and signal divider may be selected from a range of approximately 2.4-12, for example. These values are for commonly available dielectric materials. Dielectric materials having higher or lower values may be used when they become available.

In another embodiment, a metallic cladding layer around the DWG and/or DWG signal divider may be used to provide isolation from external effects, such as touching other objects or touching by fingers or hands, for example.

Certain terms are used throughout the description and the claims to refer to particular system components. As one skilled in the art will appreciate, components in digital systems may be referred to by different names and/or may be combined in ways not shown herein without departing from the described functionality. This document does not intend to distinguish between components that differ in name but not function. In the following discussion and in the claims, the terms "including" and "comprising" are used in an open-ended fashion, and thus should be interpreted to mean "including, but not limited to . . . . " Also, the term "couple" and derivatives thereof are intended to mean an indirect, direct, optical, and/or wireless electrical connection. Thus, if a first device couples to a second device, that connection may be through a direct electrical connection, through an indirect electrical connection via other devices and connections, through an optical electrical connection, and/or through a wireless electrical connection.

Although method steps may be presented and described herein in a sequential fashion, one or more of the steps shown and described may be omitted, repeated, performed concurrently, and/or performed in a different order than the order shown in the figures and/or described herein. Accordingly, embodiments of the invention should not be considered limited to the specific ordering of steps shown in the figures and/or described herein.

It is therefore contemplated that the appended claims will cover any such modifications of the embodiments as fall within the true scope and spirit of the invention.

What is claimed is:

1. A dielectric waveguide system comprising:

a dielectric wave guide (DWG) having a longitudinal core member with a first dielectric constant value surrounded by a cladding with a cladding dielectric constant value that is lower than the first dielectric constant value;

a signal divider having at least three ports, wherein a first port is connected to receive a signal from the DWG and a second port and third port are each configured to output a portion of the signal received on the first port, wherein the first and second port are approximately in line and the third port is at an angle to a line formed by the first port and the second port; and wherein the first port has a core member with the first dielectric constant value, the second port has a core member with the first dielectric constant value, and the third port has a core member with a second dielectric constant value that is higher than the first dielectric constant value.

2. The DWG system of claim 1, wherein the core member of the third port includes a curved portion.

3. The DWG system of claim 2, further comprising a continuous core member region having the first dielectric constant value between the first port and the second port.

4. The DWG system of claim 1, further comprising:

a transmitting device coupled to the DWG and operable to launch a radio frequency (RF) signal into the DWG;

a first receiving device coupled to the second port and operable to receive a portion of the RF signal from the second port; and a second receiving device coupled to the third port and operable to receive a portion of the RF signal from the third port.

5. The DWG system of claim 1, wherein the first dielectric constant value is selected from a range of approximately 2.4-12 and the cladding dielectric constant is selected from a range of approximately 2.0-4.5.

6. The DWG system of claim 1, further comprising an impedance matching DWG portion coupled to the third port, wherein the impedance matching DWG portion has a core member in which the dielectric constant gradually changes from the second dielectric constant value to the first dielectric constant value.

7. A method for communicating using a dielectric waveguide (DWG), the method comprising:

launching an electromagnetic signal into a core member of the DWG, wherein the core member has a first dielectric constant value;

passing the electromagnetic signal into a transition core region having a dielectric constant value that gradually changes from the first dielectric constant value to a higher dielectric constant value; and splitting the electromagnetic signal by impressing the electromagnetic signal against a curved interface region between the transition core region having the higher dielectric constant value and another core region having a lower dielectric constant value, such that a portion of the electromagnetic signal proceeds straight through the curved interface region to a first output port while a second portion of the electromagnetic signal is reflected by the curved interface and proceeds to a second output port.

8. The method of claim 7, further comprising passing the second portion of the electromagnetic signal through a second transition region having a dielectric constant value that gradually changes from the higher dielectric constant value to the first dielectric constant value.

* * * * *